US006386306B2

(12) United States Patent
Contoli et al.

(10) Patent No.: US 6,386,306 B2
(45) Date of Patent: May 14, 2002

(54) EARTHMOVING MACHINE

(75) Inventors: Piercarlo Contoli, Faenza; Corrado Ragazzini, Brisighella, both of (IT)

(73) Assignee: New Holland North America, Inc., New Holland, PA (US)

( * ) Notice: Subject to any disclaimer, the term of this patent is extended or adjusted under 35 U.S.C. 154(b) by 0 days.

(21) Appl. No.: 09/728,357

(22) Filed: Dec. 4, 2000

(30) Foreign Application Priority Data

Mar. 1, 2002 (IT) ..... B099A 00069I

(51) Int. Cl.[7] ..... B60K 1/00
(52) U.S. Cl. ..... 180/68.4; 180/291
(58) Field of Search ..... 180/68.4, 54.1, 180/68.6, 69.2, 300, 311, 312, 313, 291, 89.1; 280/781, 783, 785; 212/195

(56) References Cited

U.S. PATENT DOCUMENTS 4,066,119 A * 1/1978 Stedman ..... 165/41
4,322,107 A * 3/1982 Ishizuka et al. ..... 296/146
5,199,583 A * 4/1993 Weider et al. ..... 212/56
5,217,344 A * 6/1993 Gendrault et al. ..... 414/729
5,899,347 A * 5/1999 Cullity ..... 212/196
6,071,066 A * 6/2000 Braud ..... 414/686
6,092,616 A * 7/2000 Burris et al. ..... 180/68.1
6,152,253 A * 11/2000 Monaghan ..... 180/291
6,167,980 B1 * 1/2001 Anderson et al. ..... 180/311
6,170,588 B1 * 1/2001 Irino et al. ..... 180/89.1
2001/0015296 A1 * 8/2001 Sewell ..... 180/68.4

* cited by examiner

*Primary Examiner*—Brian L. Johnson
*Assistant Examiner*—G B Klebe
(74) *Attorney, Agent, or Firm*—Larry W. Miller; John William Stader

(57) ABSTRACT

An earthmoving machine wherein a driver's cab and a propulsion device for powering the machine are located on opposite sides of a central lift arm. The propulsion device is provided with a cooling device located over the propulsion device itself.

3 Claims, 5 Drawing Sheets

EARTHMOVING MACHINE

BACKGROUND OF THE INVENTION

The present invention relates to earthmoving machines and is particularly advantageous for use on earthmoving machines of the type comprising two axles extending crosswise to a longitudinal axis of the machine and each fitted with two drive wheels; a driver's cab; propulsion means for powering the machine; a lift arm between the cab and the propulsion means; and a cooling assembly for cooling the propulsion means.

The cooling assembly is located between the propulsion means and one of the two axles, and normally comprises a substantially parallelepiped-shaped radiator in turn comprising two parallel major lateral faces perpendicular to the longitudinal axis of the machine, and an impeller mounted facing one of the major lateral faces of the radiator to rotate about a respective axis of rotation substantially parallel to the longitudinal axis.

One drawback of known earthmoving machines of the above type lies in the location of the cooling assembly, which results in a relatively long wheel base—i.e. the distance, measured parallel to the longitudinal axis of the machine, between the two axles—thus reducing maneuverability because of the big turning circle radius of the machine.

Another drawback of known earthmoving machines of the above type lies in the cooling assembly being located fairly close to the ground and the drive wheels, and therefore being fouled relatively easily by dirt thrown up by the drive wheels during operation of the machine.

SUMMARY OF THE INVENTION

It is an object of the present invention to provide an earthmoving machine designed to eliminate the aforementioned drawbacks.

According to the present invention, there is provided an earthmoving machine comprising a lift arm mounted for rotation about a first axis; a driver's cab; propulsion means for powering the machine, said propulsion means and said cab being located on opposite sides of said lift arm; and cooling means for cooling said propulsion means; characterized in that said cooling means are located substantially over said propulsion means.

These and other objects, features and advantages are accomplished according to the instant invention by providing an earthmoving machine having a driver's cab and a propulsion device for powering the machine which is located on opposite sides of a central lift arm. The propulsion device is provided with a cooling device that is located over the propulsion device itself.

BRIEF DESCRIPTION OF THE DRAWINGS

The advantages of this invention will become apparent upon consideration of the following detailed disclosure of the invention, especially when taken in conjunction with the accompanying drawings, wherein.

DETAILED DESCRIPTION OF THE PREFERRED EMBODIMENTS

Figure 1:
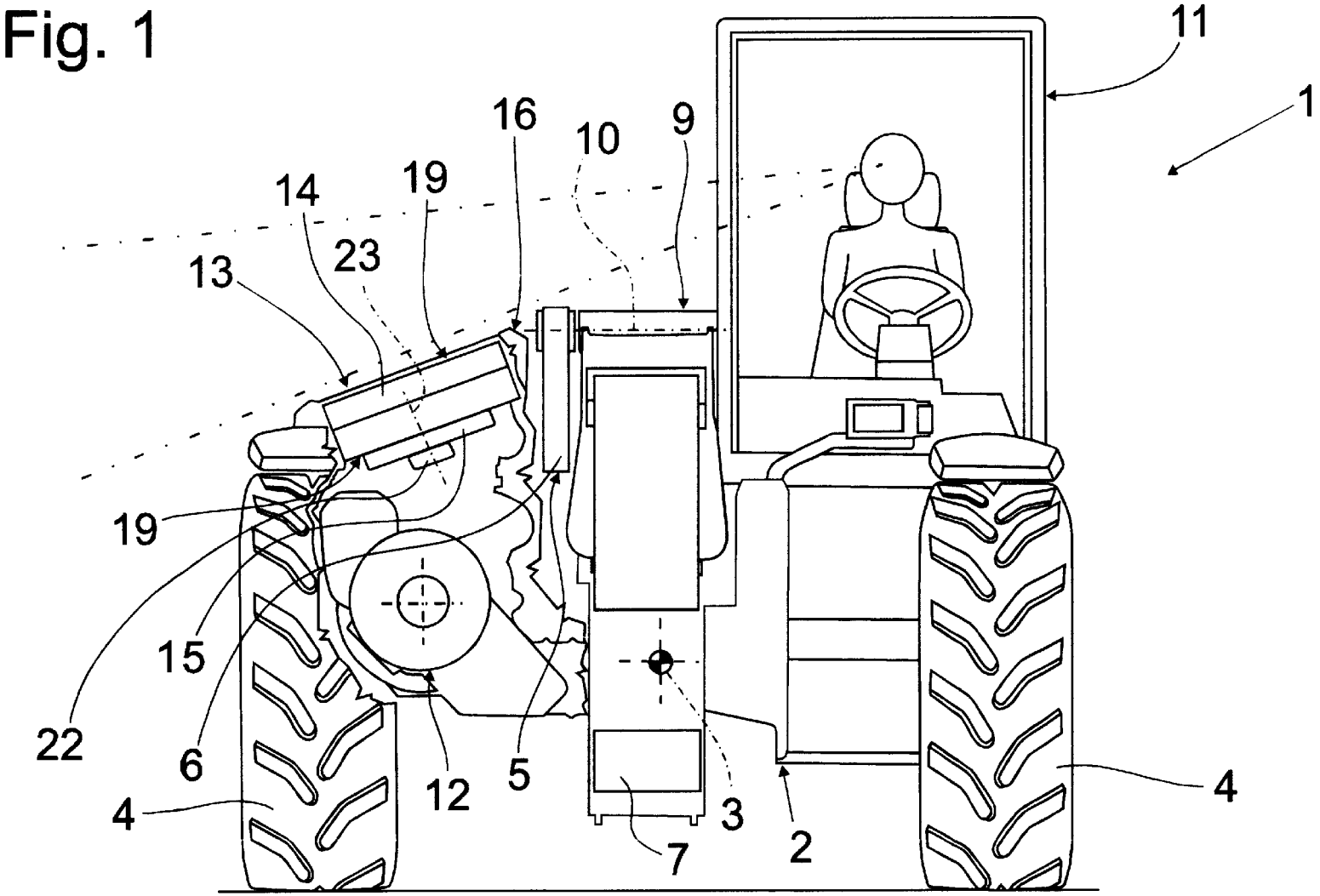
FIG. 1 is a front elevational view of an earthmoving machine incorporating the principles of the instant invention, certain portions of the machine have been removed for purposes of clarity.
Figure 2:
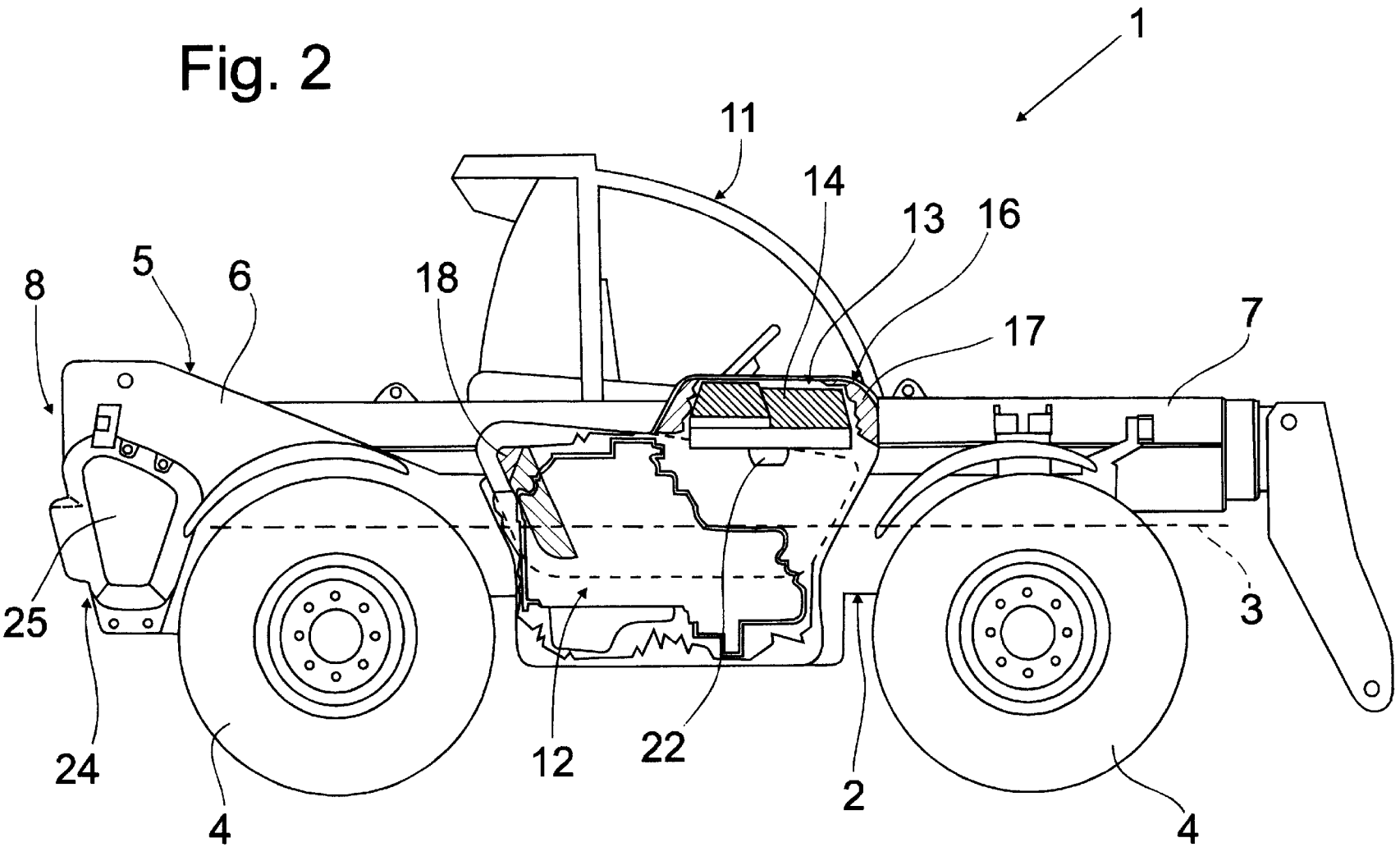
FIG. 2 is a side elevational view of the earthmoving machine shown in FIG. 1 with portions being removed for purposes of clarity.

Referring first to the front elevational view of the earthmoving machine incorporating the principles of the instant invention, as depicted in FIG. 1, the earthmoving machine 1 includes a frame 2 having a longitudinal axis 3 and supporting two conventional axles (not shown) extending crosswise to axis 3, with each axle supporting two opposing drive wheels 4.

Figure 4:
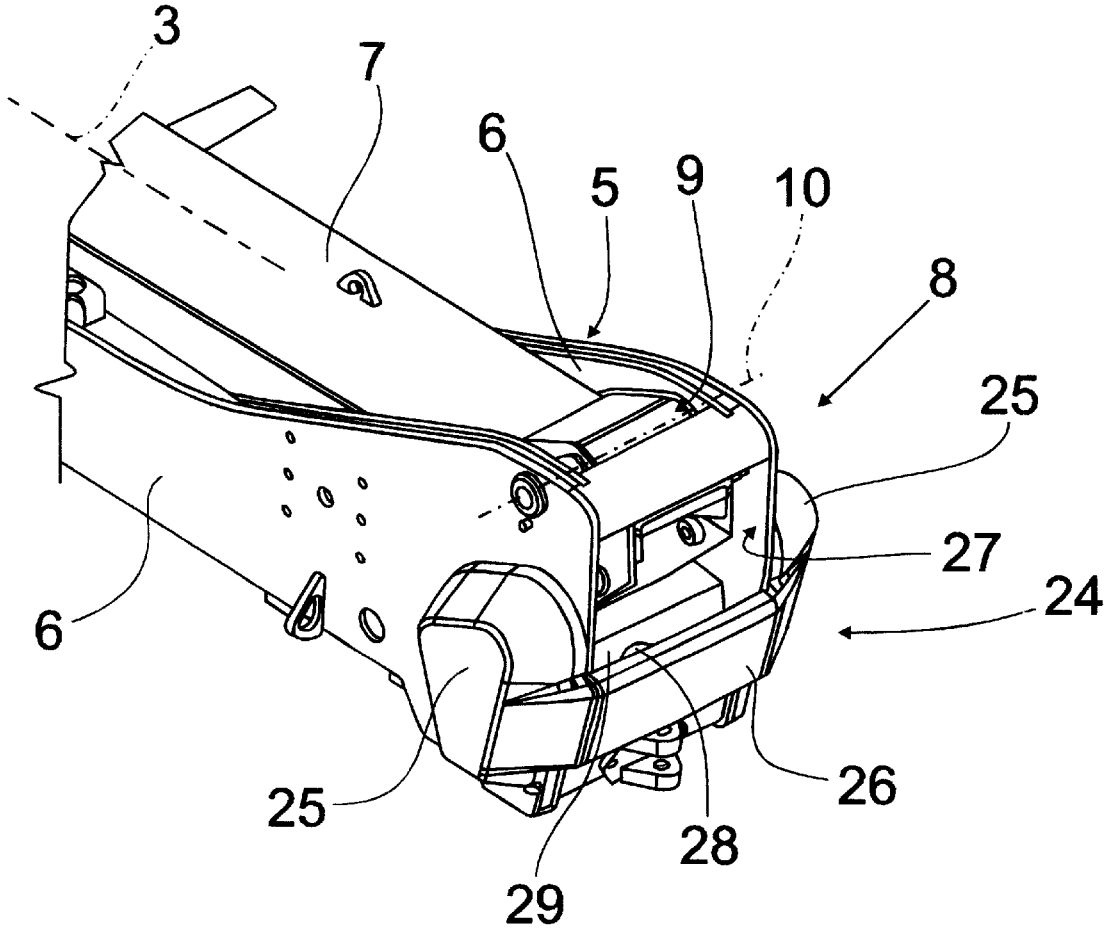
FIG. 4 is a perspective detail view of a second portion of the earthmoving machine of FIG. 1.
Figure 5:
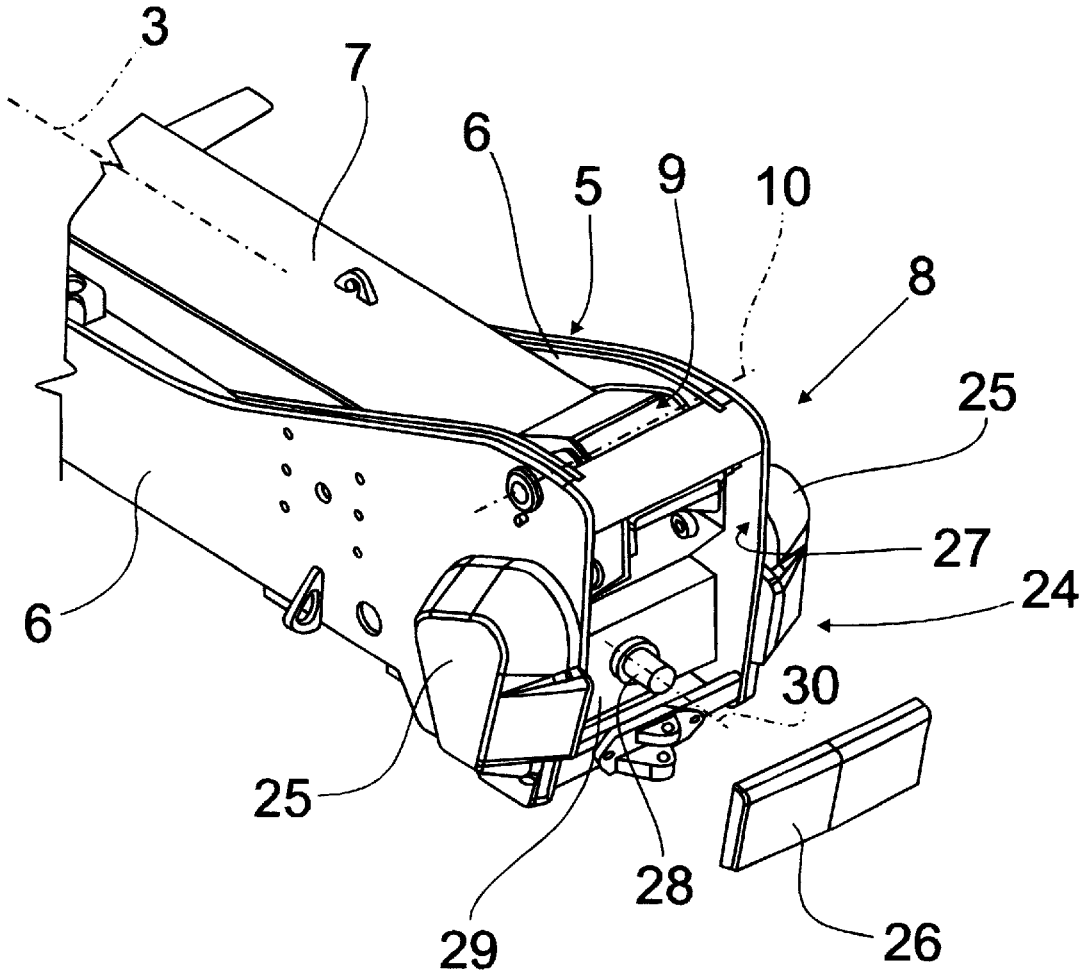
FIG. 5 is a partially exploded perspective detail view of the second portion of the earthmoving machine shown in FIG. 4.

The earthmoving machine 1 is also provided with a central supporting member 5 fixed to the frame 2 and is formed from two parallel elongated plates 6 oriented parallel to and on either side of the axis 3. Furthermore, the earthmoving machine 1 is provided with a telescopic lift arm 7 hinged to a rear end 8 of member 5, as best seen in FIGS. 4 and 5, to swing, with respect to member 5 by virtue of a conventional actuating device 9, such as a hydraulic motor, about an axis 10 oriented substantially crosswise to axis 3.

The earthmoving machine 1 also includes a driver's cab 11 to the side of arm 7; and an engine 12 for powering the earthmoving machine 1. The engine is preferably located between the wheels 4 and on the opposite side of arm 7 from the cab 11.

The engine 12 has a longitudinal axis 12*a* substantially parallel to axis 3, and a cooling assembly 13 located over the engine 12. The cooling assembly 13 includes a radiator 14 and an impeller 15, both of which are housed, together with engine 12, inside a casing 16 including an air inlet grille 17 and three air outlet grilles 18.

Figure 3:
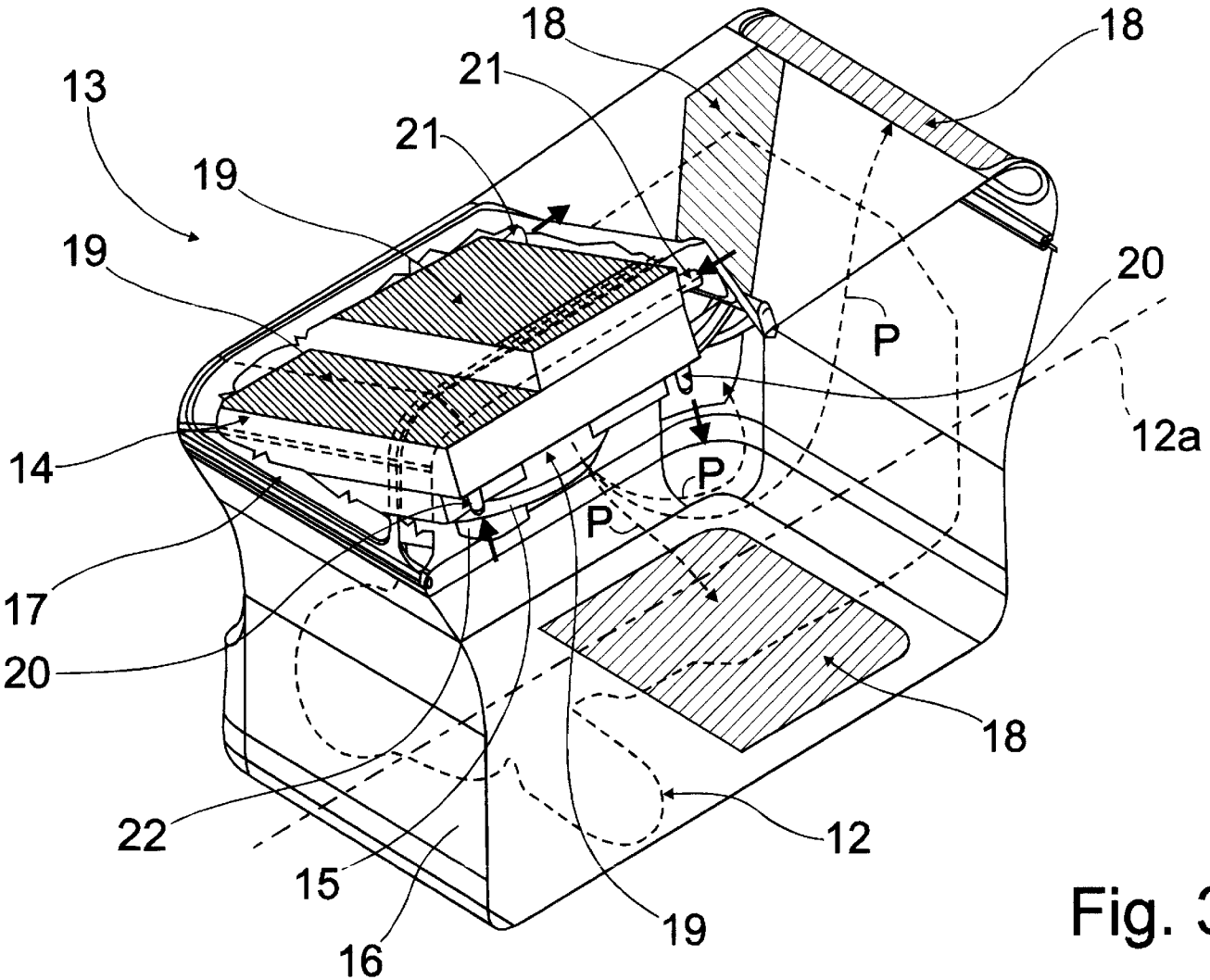
FIG. 3 is a perspective detail view of a first portion of the earthmoving machine shown in FIG. 1, portions being removed for clarity.

With reference to FIGS. 1 and 3, the radiator 14 is positioned facing grille 17, and is formed in a substantially parallelepiped-shape. The radiator 14 has two parallel major lateral faces 19 and is fitted to the frame 2 so that the two faces 19 form an angle of other than zero with respect to the axis 10. More specifically, the two faces 19 slope downwardly from the central member 5 to prevent the cooling assembly 13 from blocking the view of the driver when positioned inside of the cab 11, and also to prevent an excessive amount of dirt from depositing on the cooling assembly 13 itself.

The radiator 14 forms part of a hydraulic circuit 20 for cooling the engine 12, and of a pneumatic circuit 21 for cooling the intake air of the engine 12.

The impeller 15 is located between the radiator 14 and the engine 12. The impeller 15 is mounted to rotate with respect to radiator 14 by virtue of a known actuating device 22, such as a hydraulic motor, about an axis 23 substantially perpendicular to the two faces 19. In this connection, it should be noted that the impeller 15 provides for feeding the air inside the casing 16 along a path P, best seen in FIG. 3, extending between the grille 17 and the three grilles 18, so as to cool the radiator 14 and also assist in cooling the engine 12.

The earthmoving machine 1 also includes a balancing device 24, best seen in FIGS. 4 and 5, for balancing the weight of the arm 7. The balancing device 24 is preferably located at the end 8 and is formed from two fixed counterweights 25 fitted to the outside of the plates 6 on either side of the axis 3, and a counterweight 26 fitted removably to the member 5 between the two counterweights 25 and crosswise to the axis 3. When fitted to the member 5, counterweight 26 defines a rear housing 27 at the end 8, between the plates 6 and beneath the arm 7, to house a power takeoff 28 mounted for rotation with respect to the member 5 by virtue of a known actuating device 29, such as a hydraulic motor, about a respective longitudinal axis 30 substantially parallel to the axis 3.

The location of cooling assembly 13 provides for obtaining a relatively short wheel base of machine 1, i.e. the distance measured parallel to axis 3, between the axles (not shown), which improves the maneuverability of machine 1 by reducing the turning circle radius as compared to the earthmoving machines known in the prior art. Moreover, the off-ground height of cooling assembly 13 prevents an excessive amount of dirt thrown up by the drive wheels 4 during operation of the earthmoving machine 1 from coming into contact with the radiator 14 and the impeller 15.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. In an earthmoving machine having a main longitudinal frame supported by wheels that are affixed to two longitudinally-spaced axles, said main frame having front and rear opposing ends and a longitudinal axis between opposing pairs of said wheels, a single elongated lift arm pivotably affixed to said main frame about a generally horizontal first axis adjacent said rear end of said main frame and extending generally therefrom along said longitudinal axis of said main frame toward said front end thereof, a cab with operator controls and a seat for an operator, said cab supported by said main frame and located adjacent said lift arm on a first side of said lift arm, the improvement comprising:

an engine longitudinally supported by said main frame for providing operational power to said machine, said engine located on a second side of said lift arm opposite said cab;

said cab including at least one window providing a horizontal and vertical field of view over said engine for an operator situated in said seat;

a cooling mechanism for cooling said engine, said cooling mechanism comprising a substantially parallelepiped-shaped radiator having two substantially parallel major lateral faces, said lateral faces sloping outwardly and downwardly relative to said main frame at an angle greater than zero degrees with a horizontal plane through said first axis and located on said second side of said lift arm, above said engine such that said vertical field of view over said engine is greater than if said lateral faces were horizontal;

an impeller mounted for rotation about a second axis substantially perpendicular to said lateral faces; and a casing supported by said main frame and enclosing said engine and said cooling mechanism, said casing having an air inlet grill adjacent to and above said radiator, and air outlet grills including one below said engine, said impeller positioned to move air through said casing along a predetermined path from said air inlet grill to said air outlet grills to cool said radiator and said engine.

2. The earthmoving machine of claim 1, further including:

a balancing mechanism including at least one counterweight removably supported by said main frame adjacent to said rear end thereof, said mechanism comprising a housing supporting said lift arm and having said at least one counterweight defining a rear portion of said housing.

3. The earthmoving machine of claim 2, further including:

power takeoff mounted for rotation about an axis substantially perpendicular to said first axis and located at said rear end of said main frame.

* * * * *